United States Patent [19]

Shofner

[11] 4,245,659

[45] Jan. 20, 1981

[54] CRUTCH ASSEMBLY

[76] Inventor: Martin K. Shofner, 112 Audubon Rd., Shelbyville, Tenn. 37160

[21] Appl. No.: 16,906

[22] Filed: Mar. 2, 1979

[51] Int. Cl.[3] ..... A61H 3/02

[52] U.S. Cl. ..... 135/68

[58] Field of Search ..... 135/68, 65, 69, 71–76; 224/158, 160

[56] References Cited

U.S. PATENT DOCUMENTS

| | | | |
|---|---|---|---|
| 1,063,846 | 6/1913 | Winthers | 135/68 |
| 1,244,928 | 10/1917 | Walters | 135/72 |
| 2,189,429 | 2/1940 | Lundquist | 135/68 |
| 2,667,917 | 2/1954 | Dustin | 135/73 |
| 3,289,685 | 12/1966 | Parker | 135/69 X |
| 4,094,330 | 6/1978 | Jong | 135/69 |

*Primary Examiner*—J. Karl Bell

[57] ABSTRACT

A crutch assembly including a cross-member adapted to be strapped to a user, and a pair of spaced crutch members attached to the cross-member in such a way as to be free to pivot through a solid angle with respect to the cross-member.

21 Claims, 12 Drawing Figures

CRUTCH ASSEMBLY

This invention relates to crutches.

A principal object of the present invention is to provide a crutch assembly which better distributes the weight of the user, relieving the pressure points conventionally produced under the arms and at the wrists, hands and elbows, and thus requiring less energy. Other objects include providing such crutch assemblies that can be easily adjusted in length according to the particular user or, during use, to the particular situation.

The invention features a cross-member adapted to be strapped to a user, and a pair of crutch members attached to the cross-member in such a way as to be free to pivot through a solid angle with respect to the cross-member. In preferred embodiments, the crutch members of the assembly are free to pivot through solid angles of about $\pi/2$ steradians, i.e., 45° to the front and rear, and 30° in towards and 60° out away from the user. Each crutch member may either be a short assembly adapted for connection to a conventional crutch, or a full length crutch. A full length crutch member comprises a pair of telescoping supports to be moved relative to each other to adjust the crutch member in length, and at the proper length to be locked in position.

Other objects, features and advantages will appear from the following detailed description of preferred embodiments of the invention, taken together with the attached drawings in which.

Figure 1:
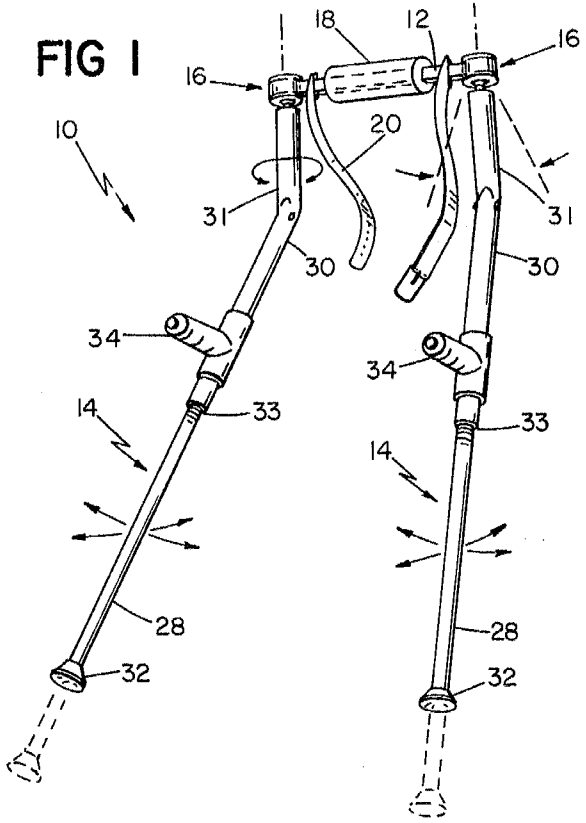
FIG. 1 is a perspective view of a first preferred embodiment.
Figure 5C:
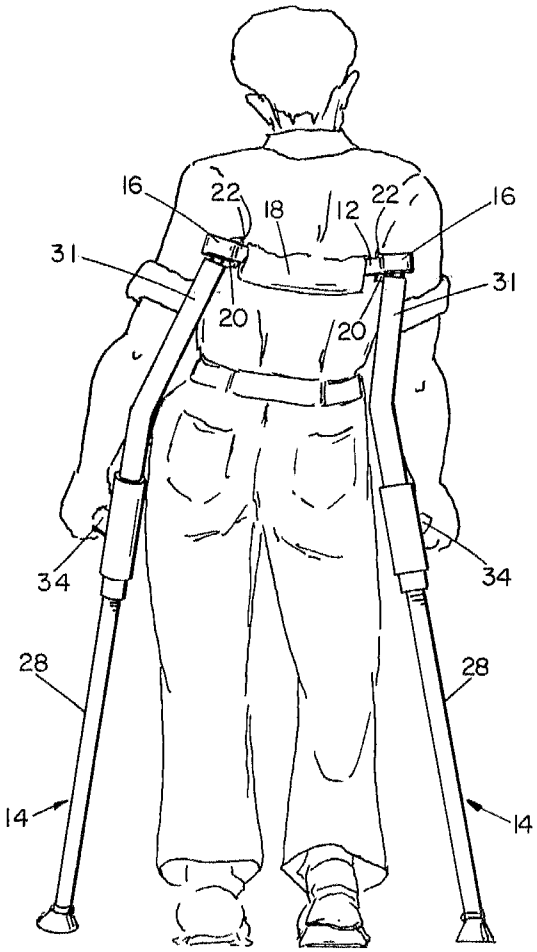
Figure 5B:
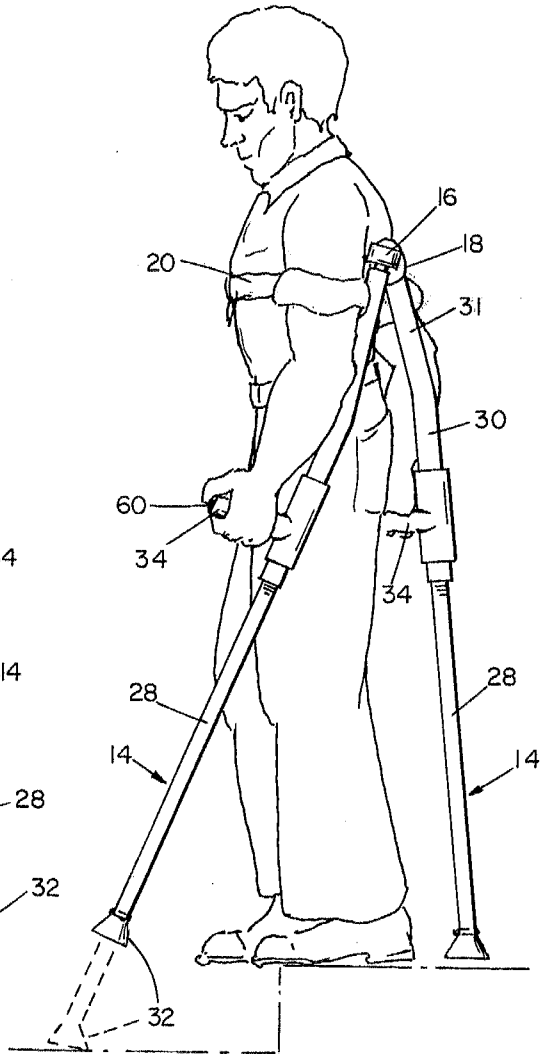
Figure 5A:
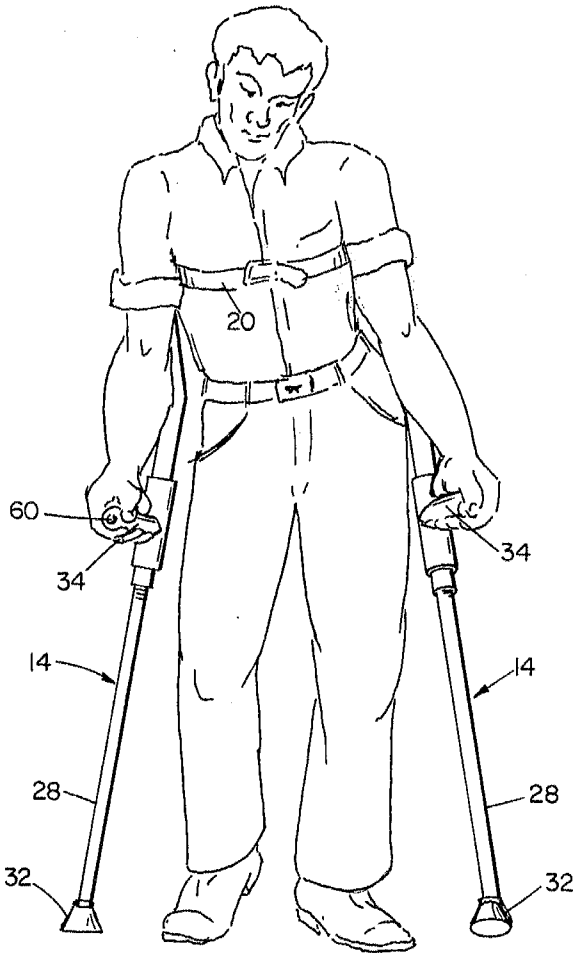
Figures 6, 7, 8, 9, 10:
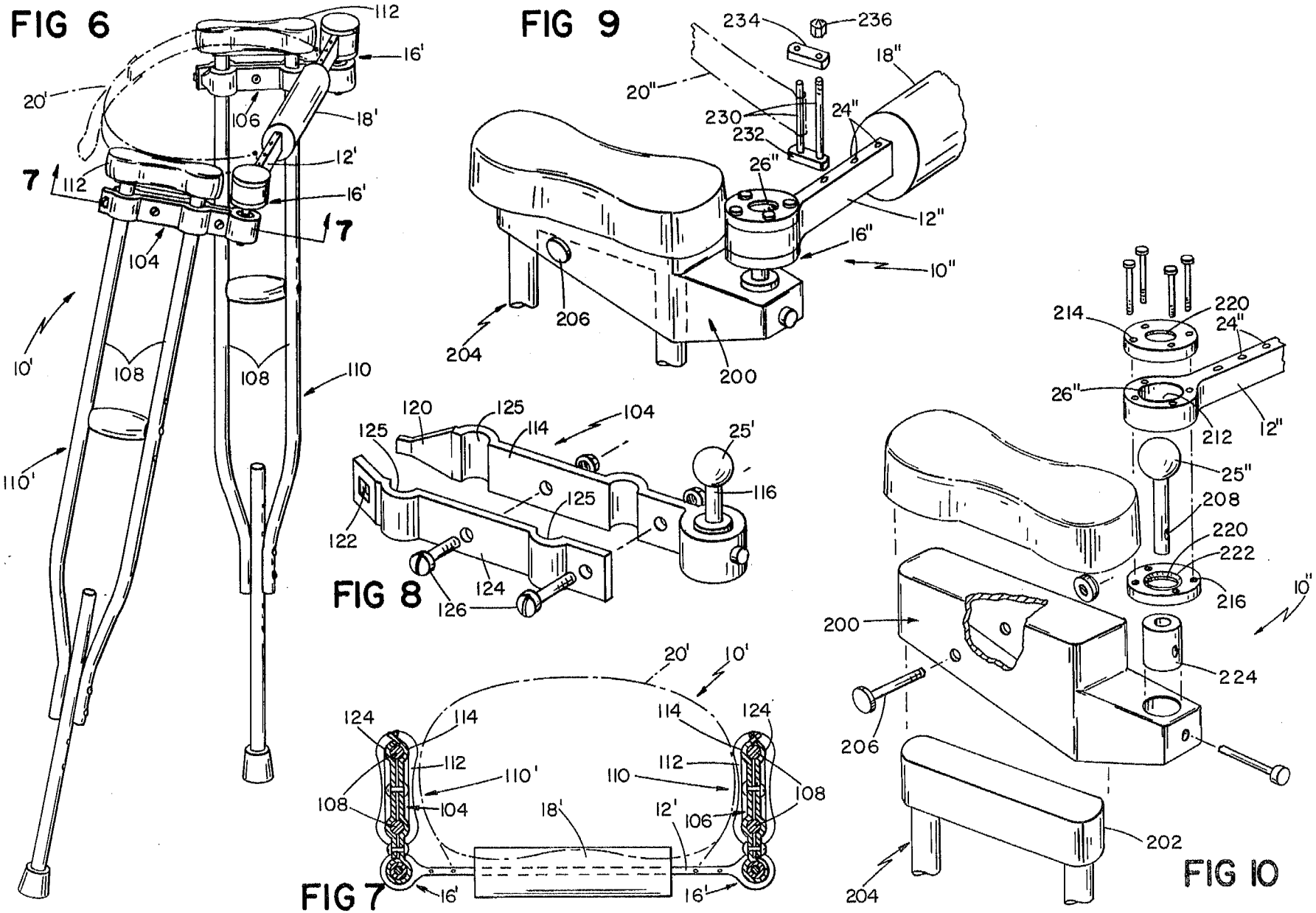

FIGS. 5 A–C show the embodiment of FIG. 1 attached to a user;

FIG. 6 is a perspective view of a second preferred embodiment;

FIG. 7 is a sectional view taken at 7—7 of FIG. 6;

FIG. 8 is a perspective exploded view of portion of the embodiment of FIG. 6; and, FIGS. 9 and 10 are perspective, partially exploded views of a third embodiment.

FIGS. 1–5 disclose a crutch assembly, generally designated 10, comprising a cross bar 12 having crutches 14 attached to the opposite ends thereof by ball and socket joints 16. In the disclosed embodiment, a padded sleeve 18 covers bar 12 along most of its length. The opposite ends of an adjustable strap 20 are attached by split "D" rings 22 to bar 12 adjacent its ends. As shown, each "D" ring 22 projects into diametrically-opposed drilled holes 24 in bar, a series of such holes being provided adjacent each end of bar 12 so the distance between the ends of straps 20 may be varied to fit a particular user.

Each ball and socket joint 16 includes a ball 25 attached to the upper end of a crutch 14 and received within a socket 26 at the adjacent end of bar 12, and permits the crutch 14 to pivot relative to bar 12 through a solid angle (i.e., both back and forth and to the side). In the disclosed embodiment, the solid angle is about $\pi/2$ steradians (i.e., movement is permitted through an arc of about 45° both back and forth, and 30° in and 60° out away from the user); and preferably the movement permitted will never be less than about 30° back and forth and out from the side.

Each crutch 14 includes a pair of telescoping cylindrical tubes 28, 30. A broad-based flexible rubber tip 32 fits on the bottom of the lower, smaller diameter tube 28; and ball 25 is fixed to the top of the larger diameter tube 30. As shown, upper tube 30 is bent about 25° in an area, designated 31, about one-third of the way down from its upper end. Lower tube 28 is straight. Handle 34 projects generally perpendicularly from upper tube 30, about one foot below bend 31 and a short distance above the bottom 33 of tube 30. The upper portion of tube 28 fits within tube 30, forming a slip-fit so that the two tubes may be moved axially relative to each other.

Figure 3:
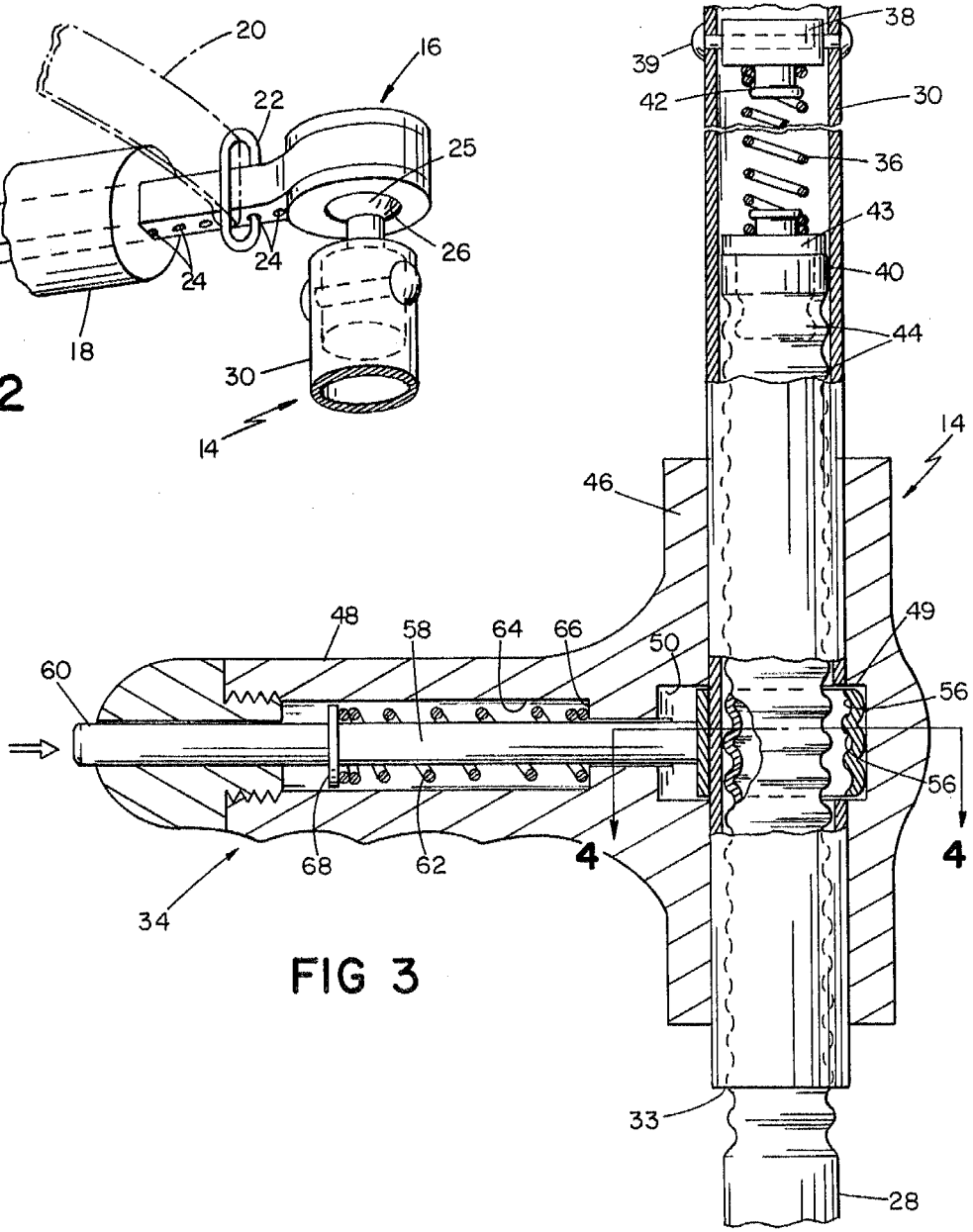
FIG. 3 is a sectional plan view taken at 3—3 of FIG. 1.
Figure 2:
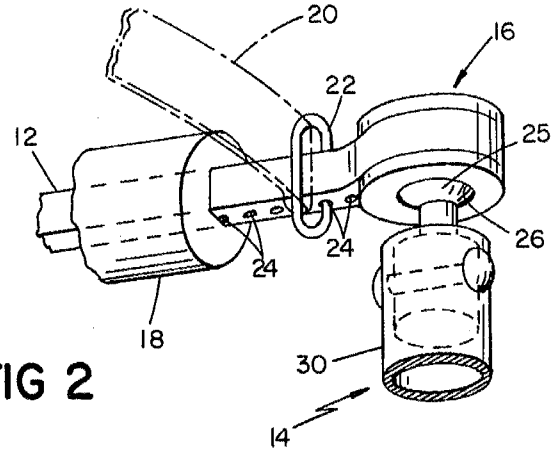
FIG. 2 is a perspective view of portion of the first embodiment.
Figure 4:
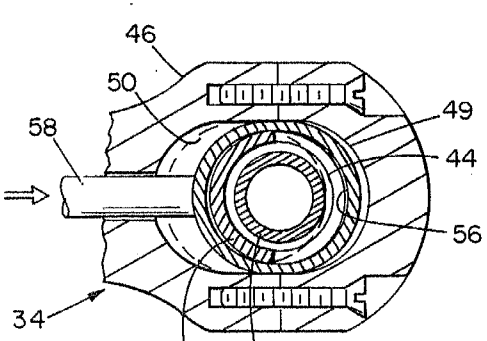
FIG. 4 is a sectional view taken at 4—4 of FIG. 3.

The system for permitting adjustment of the length of each crutch 14 is shown most clearly in FIGS. 3 and 4. A helical spring 36 within tube 30 is interposed between a stop 38 carried by through bolt 39 and the upper end 40 of tube 28. A stepped cylindrical plug 42 projects axially downwardly from stop 38 a short distance into the top of spring 36; and a similar plug 43 is fitted into tube upper end 40, both engaging the lower axial end of the spring 38 and projecting a short distance into the bottom of the spring. The exterior upper portion of tube 28, front end downwardly a distance of slightly over a foot, defines a number of circular axially spaced ribs 44, the outer periphery of which form slip-fits with the inner surface of tube 30.

Handle assembly 34 comprises a "T", including sleeve 46 surrounding and attached to tube 30 and a cylindrical grip 48 projecting generally perpendicular to the axes of sleeve 46 and tube 30. A generally annular recess 50, aligned with grip 48 within and midway the length of sleeve 46, overlies a cut-away portion 49 of the cylindrical wall of tube 30. As shown in FIG. 4, an adjusting stop 52, generally oblong in cross-section perpendicular to the axis of tube 28, is mounted in recess 50 surrounding tube 28. The inner bore 54 of stop 52 has a width (perpendicular to the axis of grip 34) slightly greater than the outside diameter of tube 28, a length (parallel to the axis of grip 34) greater than the sum of the diameter of tube 30 and the height (peak to valley) of tube ribs 44. A plurality of axially-spaced grooves 56 arranged to receive and engage ribs 44 are provided on the side of stop 52 opposite grip 48. A push rod 58 is attached to the side of stop 52 opposite grooves 56, and extends axially through the length of grip 48, providing a projecting push button 60. Compression spring 62 surrounds rod 58, within grip 48, with the opposite ends of the spring engaging the end 66 of grip central bore 64 nearest stop 52 and an annular ring 68 on rod 58.

As will be evident, spring 62 tends to draw grooves 56 of stop 52 onto engagement with tube ribs 44, thus locking tube 28 in place axially relative to tube 30. To adjust the length of crutch 14, push button 60 is depressed (as shown in FIG. 3), moving the grooves 56 of stop 52 out of engagement with ribs 44 of tube 28, so that tube 28 is free to slide axially, relative to and within tube 30.

In use, a wearer 100 places cross bar 12 behind his back and straps himself to it. In the illustrated embodiment, cross bar 12 is positioned just below the user's shoulder blades, and strap 22 is buckled under his arms and across his chest, all as shown in FIGS. 5 A–C. Crutches 14 may be positioned, as desired, when walking or standing; and their length may be adjusted at any time, even in use as, for example, when descending stairs 102 as shown in FIG. 5B.

OTHER EMBODIMENTS

FIGS. 6–8 illustrate a second embodiment, generally designated 10', for use with conventional crutches. In the FIGS. 5 and 6 embodiments, clamp assemblies 104, 106 are connected by ball and socket joints 16' to the opposite ends of padded cross bar 12'. Each clamp assembly 104, 106 securely engages the adjacent uprights 108 of a conventional crutch 110, just below the padded rest 112 of the top of the crutch 110. Each of clamp assemblies 104, 106 includes a base member 114 one end 116 of which is attached to the post 118 carrying ball 25' and the other end 120 of which engages a slot 122 in clamp cover member 124. Recesses 125 in base member 114 and cover member 124 are shaped to receive crutch uprights 108, and bolts 126 attach the base and cover members to each other securely engaging the crutch uprights therebetween. As with the previously discussed embodiment, the user straps the entire crutch assembly 10' into place, with cross bar 12' held in place behind his or her back and chest encircling strap 20' passing under arm.

A third embodiment 10'', which like assembly 10' is designed for use with conventional crutches, is shown in FIGS. 9 and 10. As there shown, the ball and socket joint 16'' at the end of padded bar 12'' is attached to a molded cap 200 designed to fit over the washer 202 at the top of a conventional crutch 204 and be held in place by a through bolt 206 passing under the washers. A padded cover 208 fits over cap 206.

FIGS. 9 and 10 also illustrate the construction of the ball and socket joint used in all the herein described embodiments, and of a modified connector 210, for use in any of the described embodiments, for connecting strap 20; to bar 12''.

As shown, socket 26'' is formed by a cylindrical bore 212 at an end of bar 12'', the top and bottom of which are closed by identical circular plates 214, 216, bolted in place. Ball 25'' fits closely within bore 212, with its post 216 extending through a central hole 220 in plate 16, and engages ball recesses 222 (each in the form of a spherical zone) on the inner surfaces of plates 214, 216 surrounding holes 220. One end of post 208 is welded in place in a radial bore in ball 25''; its other end is pinned in a bearing sleeve 224 at one end of cap 200.

Strap connector 210 includes a pair of bolts 230 welded at one end to a base plate 232, extending upwardly through an upper plate 234, and capped by nuts 236. One of bolts 230 passes through a loop at the end of strap 20''; the other through the selected one of holes 24''.

In still further embodiments, the cross-bar connecting the two crutch supports may be circular in cross-section and slightly curved along its length better to fit the back of the user; the lower tube of the crutch may be of greater rather than smaller diameter than the upper; means other than that shown (e.g., pneumatic) may be used to adjust crutch length or the crutches may be fixed in length; the ball of each ball-and-socket joint may be carried by the cross-bar and the socket by the crutch support; under-arm straps or a complete harness may be used in addition to or in lieu of simply a cross-chest strap; and means may be provided for varying the vertical distance from the ball-and-socket joint to the projecting handle.

These and other embodiments will be within the scope of the following claims.

What is claimed is:

1. A crutch assembly comprising:

a support arranged to engage and be secured to the chest and back of a user at a level adjacent the shoulder blades of the user; and, a pair of spaced crutch members, each of said crutch members depending generally downwardly from said support when said support is secured to said user and being secured to said support for movement relative thereto through a solid angle.

2. The assembly of claim 1 wherein said support includes a cross bar and attachment means secured to said cross bar for attaching said assembly to said user.

3. The assembly of claim 1 wherein said crutch members are attached by ball-and-socket joints to the opposite ends of said support.

4. The assembly of claim 2 or 1 wherein each of said crutch members is movable relative to said support through a solid angle of about $\pi/2$ steradians.

5. The assembly of claim 2 or 1 wherein each of said crutch members is movable relative to said member through an angle of about 30° back and forth and to one side.

6. The assembly of claim 2 wherein said means is a harness or strap spaced-apart portions of which are attached to said cross bar.

7. The assembly of claim 6 including means for varying the distance between the points at which said spaced-apart portions are attached to said cross bar.

8. The assembly of claim 7 wherein said means for varying said distance includes a plurality of spaced holes in said cross bar and connectors carried by said attachment means and arranged to engage selected ones of said spaced holes.

9. The assembly of claim 1 wherein said support includes a cross bar and a resilient pad surrounding a length of said cross-bar and adapted to engage the back of a user.

10. The crutch assembly of claim 1 wherein each of said crutch members includes a connector arranged for attachment to a crutch.

11. The assembly of claim 10 wherein said connector includes clamps arranged to engage the uprights of a crutch.

12. The assembly of claim 10 wherein said connector includes a cap arranged to fit over the top of a crutch.

13. The assembly of claim 10 wherein an end of said connector is attached to said support by a ball-and-socket joint.

14. The assembly of claim 1 wherein each of said crutch members extends from an upper end thereof adjacent said support member to a lower end adapted to rest on a floor, and includes a handle intermediate and means for varying the length of said each crutch member between said upper and lower ends.

15. The assembly of claim 14 wherein each said crutch member includes a pair of generally coaxial elongated members, one partially within and movable generally axially relative to the other, a locking member fixed axially relative to one of said elongated members and movable in a direction generally perpendicular to the axis thereof between a locking position engaging the other of said elongated members and fixing said elongated members axially relative to each other and a second position spaced from said other elongated member and permitting said relative axial movement of said elongated members.

16. The assembly of claim 15 wherein said locking member includes a generally oblong locking element surrounding said other elongated member, adjacent portions of said locking element and said other elongated member defining means adapted to engage each other and fix said locking element and other elongated member relative to each other in any one of a plurality of predetermined relative positions.

17. The assembly of claim 15 including a spring biasing said locking element towards said locking position.

18. The assembly of claim 15 wherein said handle projects from the portion of the outer one of said elongated members surrounding the inner one of said elongated members, an aperture is provided in the wall of the outer one of said elongated members on the side thereof generally opposite said handle, an adjusting stop defining a plurality of protuberances extends into said aperture and engages cooperating protuberances defined by the inner one of said elongated members, a control rod connected to said adjusting stop extends through said handle and is movable to move said adjusting stop protuberances into and out of engagement with said inner elongated member protuberances, and a spring biases said adjusting stop protuberances into engagement with said inner elongated member protuberances.

19. A crutch assembly comprising:

a support arranged to engage and be secured to the chest and back of a user at a level adjacent the shoulder blades of the user and including a cross bar and strap means attached to said cross bar for securing said cross bar to said user; and, a pair of crutch members attached to said cross bar, each of said crutch members being movable relative to said cross bar through a solid angle of about $\pi/2$ steradians.

20. The crutch assembly of claim 19 wherein said cross bar is arranged to engage one of the back and chest of said user, and said strap means is a harness or strap spaced apart portions of which are attached to said cross bar and are arranged to pass under the arms of said user.

21. The crutch assembly of claim 19 wherein said cross bar is arranged to engage the back of said user.

* * * * *